US010504672B2

(12) United States Patent
Hu

(10) Patent No.: US 10,504,672 B2
(45) Date of Patent: Dec. 10, 2019

(54) KNOB SWITCH DEVICE

(71) Applicant: Xiamen Axent Corporation Limited, Xiamen (CN)

(72) Inventor: Jianru Hu, Xiamen (CN)

(73) Assignee: XIAMEN AXENT CORPORATION LIMITED, Xiamen (CN)

( * ) Notice: Subject to any disclaimer, the term of this patent is extended or adjusted under 35 U.S.C. 154(b) by 0 days.

(21) Appl. No.: 15/770,131

(22) PCT Filed: Oct. 20, 2016

(86) PCT No.: PCT/CN2016/102639
§ 371 (c)(1),
(2) Date: Apr. 20, 2018

(87) PCT Pub. No.: WO2017/067468
PCT Pub. Date: Apr. 27, 2017

(65) Prior Publication Data

US 2018/0315560 A1 Nov. 1, 2018

(30) Foreign Application Priority Data

Oct. 21, 2015 (CN) ..... 2015 2 0818161 U

(51) Int. Cl.
*H01H 19/14* (2006.01)
*H01H 25/00* (2006.01)
*H01H 25/06* (2006.01)

(52) U.S. Cl.
CPC ..... *H01H 19/14* (2013.01); *H01H 25/008* (2013.01); *H01H 25/06* (2013.01); *H01H 2221/01* (2013.01)

(58) Field of Classification Search
CPC .... H01H 2003/008; H01H 5/02; H01H 3/503; H01H 2003/506; H01H 2215/05;
(Continued)

(56) References Cited

U.S. PATENT DOCUMENTS 4,837,413 A 6/1989 Schwab
5,894,118 A 4/1999 Nishimoto
(Continued)

FOREIGN PATENT DOCUMENTS

CN 201489386 U 5/2010
CN 201526084 U 7/2010
(Continued)

OTHER PUBLICATIONS

International Search Report for PCT/CN2016/102639 dated Feb. 3, 2017; 11 pages including English translation.
(Continued)

*Primary Examiner* — Ahmed M Saeed
(74) *Attorney, Agent, or Firm* — Schwabe Williamson & Wyatt, PC

(57) ABSTRACT

A knob switch device includes a knob portion and a control circuit portion. The control circuit portion is electrically connected to an encoder and at least one switching component. The knob portion includes a knob configured to control the encoder, and further includes a trigger mechanism configured to trigger the switching component. The knob drives the trigger mechanism to trigger the switching component by an axial movement. The knob transforms a change in a mechanical rotation angle into an electrical signal, and the functional mode of the intelligent closestool is switched by pressing or pulling the knob in the axial direction. In this way, the multiple functions of the intelligent closestool are flexibly controlled by using a single knob, and the knob switch device has a compact and small structure, thereby shortening the distance between a person and the intelligent closestool.

13 Claims, 13 Drawing Sheets

(58) Field of Classification Search
CPC ..... H01H 36/00; H01H 2071/7481; H01H 2215/042; H01H 2219/004; H01H 36/0066; H01H 36/008; H01H 3/10
USPC ..... 200/404; 335/205, 207, 219, 220, 106, 335/170, 229, 306
See application file for complete search history.

(56) References Cited

U.S. PATENT DOCUMENTS

| | | | | |
|---|---|---|---|---|
| 6,288,351 | B1 | 9/2001 | Bruntz | |
| 6,636,197 | B1 | 10/2003 | Goldenberg | |
| 8,878,657 | B2 | 11/2014 | Periquet | |
| 2011/0109411 | A1* | 5/2011 | Lee | H01H 1/54 335/207 |
| 2014/0262701 | A1* | 9/2014 | Heater | G05G 1/08 200/4 |

FOREIGN PATENT DOCUMENTS

| | | | |
|---|---|---|---|
| CN | 103019297 | A | 4/2013 |
| CN | 203745945 | U | 7/2014 |
| CN | 104319149 | A | 1/2015 |
| CN | 205159175 | U | 4/2016 |
| EP | 0265883 | A2 | 5/1988 |
| WO | 2012/104702 | A1 | 8/2012 |

OTHER PUBLICATIONS

Extended European Search Report for EP App. No. 16856899.6 dated May 9, 2019; 7 pages.

* cited by examiner

KNOB SWITCH DEVICE

CROSS-REFERENCE TO RELATED APPLICATION

The present application is a national phase entry under 35 U.S.C. § 371 of International Application No. PCT/CN2016/102639, filed Oct. 20, 2016, entitled "KNOB SWITCH DEVICE," which designates the United States of America, which claims priority to Chinese Patent Application No. 201520818161.1, filed Oct. 21, 2015 with the State Intellectual Property Office of People's Republic of China, both of which are incorporated herein by reference in their entireties.

FIELD

The present disclosure relates to the technical field of intelligent sanitary devices, relates to a contact-type switch, and in particular to a knob switch device for an intelligent pedestal pan.

BACKGROUND

With the development of science and technology and the improvement of a living standard of people, an intelligent pedestal pan gets more and more popular because of its simple manipulation, comfortable experience and rich intelligent functions. In addition to basic functions such as hip washing, washing for women, seat ring heating, drying by warm air, the existing intelligent pedestal pan further has functions of water amount and water temperature regulation, wind temperature regulation, spray head self-cleaning, night illumination and deodorization and so on. In order to achieve these rich intelligent functions, multiple buttons or knobs are to be arranged on the existing pedestal pan to achieve a specific function, thereby resulting in the complexity of the whole control device and a user interface, and greatly limiting the flexibility of product design.

SUMMARY

In the present disclosure, a knob switch device is provided, which includes a knob portion and a control circuit portion. The control circuit portion is electrically connected to an encoder and at least one switching element. The knob portion includes a knob configured to control the encoder. The knob portion further includes a trigger mechanism configured to trigger the switching element, and the knob drives the trigger mechanism to trigger the switching element by an axial movement.

Preferably, the knob portion includes a rotating shaft sleeve and a fixed shaft sleeve which is sleeved on the outside of the rotating shaft sleeve. The knob is fixedly connected to the rotating shaft sleeve and movably connected to the fixed shaft sleeve, and the encoder is movably connected to one end of the rotating shaft sleeve.

Preferably, the trigger mechanism includes: clamping slots, an elastic element and a clamping element. Two of the clamping slots are arranged at intervals in an axial direction outside of an extension part of the knob, and a distance between the two clamping slots meets a requirement of a trigger travel of the switching element. One end of the elastic element is connected to the knob. The clamping element is arranged at a non-fixed end of the elastic element, and the clamping element is clamped to the clamping slots.

Preferably, the elastic element is a spring. One end of the spring is fixed on an inner wall of the knob, and the other end of the spring extends toward the extension part of the knob.

Preferably, the elastic element is a spring piece. One end of the spring piece is fixed on the outside of the extension part of the knob, and the other end of the spring piece extends along an axial direction of the extension part of the knob.

Preferably, the trigger mechanism includes a first magnetic unit and a second magnetic unit in cooperation with each other. The first magnetic unit and the second magnetic unit are sleeved on the outside of the fixed shaft sleeve, and the first magnetic unit and the second magnetic unit can move along an axial direction of the fixed shaft sleeve. A magnetic pole of the first magnetic unit and a magnetic pole of the second magnetic unit are arranged in homopolarity. The first magnetic unit and the second magnetic unit keep a distance due to a repulsive force between the first magnetic unit and second magnetic unit.

Preferably, the first magnetic unit and the second magnetic unit are circular. An outer diameter of the first magnetic unit is smaller than an inner diameter of the second magnetic unit. The first magnetic unit can pass through an inner ring of the second magnetic unit and move reciprocally along an axial direction of the rotating shaft sleeve.

Preferably, the switching element is provided with a control rod or a distance sensor which faces the first magnetic unit and is configured to control switching of an operating mode of the switching element.

Preferably, the switching element includes a signal transmitting terminal and a signal receiving terminal. The trigger mechanism includes a shielding member, and the shielding member is arranged between the signal transmitting terminal and the signal receiving terminal.

Preferably, the signal transmitting terminal is an optocoupler transmitting terminal, an infrared transmitting terminal or a ray transmitting terminal.

BENEFICIAL EFFECT

1. With the knob switch device in the present disclosure, a change in a mechanical rotation angle is transformed into an electrical signal by rotating the knob, and the functional mode of the intelligent pedestal pan is switched by pressing or pulling the knob in the axial direction. In this way, the multiple functions of the intelligent pedestal pan is flexibly controlled by using a single knob, and the knob switch device has a compact and small structure, thereby shortening the distance between a person and the intelligent pedestal pan.

2. Components in the knob portion are connected together by the rotating shaft sleeve and the fixed shaft sleeve, such that the whole knob portion has a compact and small structure.

3. The trigger mechanism brings good hand feeling and has a simple and reliable structure by cooperation between the clamping slots and the clamping element.

4. With the cooperation of the first magnetic unit and the second magnetic unit in the trigger mechanism and the characteristics that there is no mechanical resistance and friction for the magnetic force during the pushing and pulling process, the following case can be effectively avoided. The contact-type switch and the inside of the knob are in a top touch state for long time in the rotation operation of the knob, and thus the switch is insensitive and is easy to wear. Furthermore, based on the characteristics of the magnetic force, a good hand feeling is generated when pressing or pulling the knob and the service life of the knob is long.

5. It is switched between two different modes based on whether the signal between the signal transmitting terminal and the signal receiving terminal is blocked, and the structure is simple and reliable.

Figure 1:
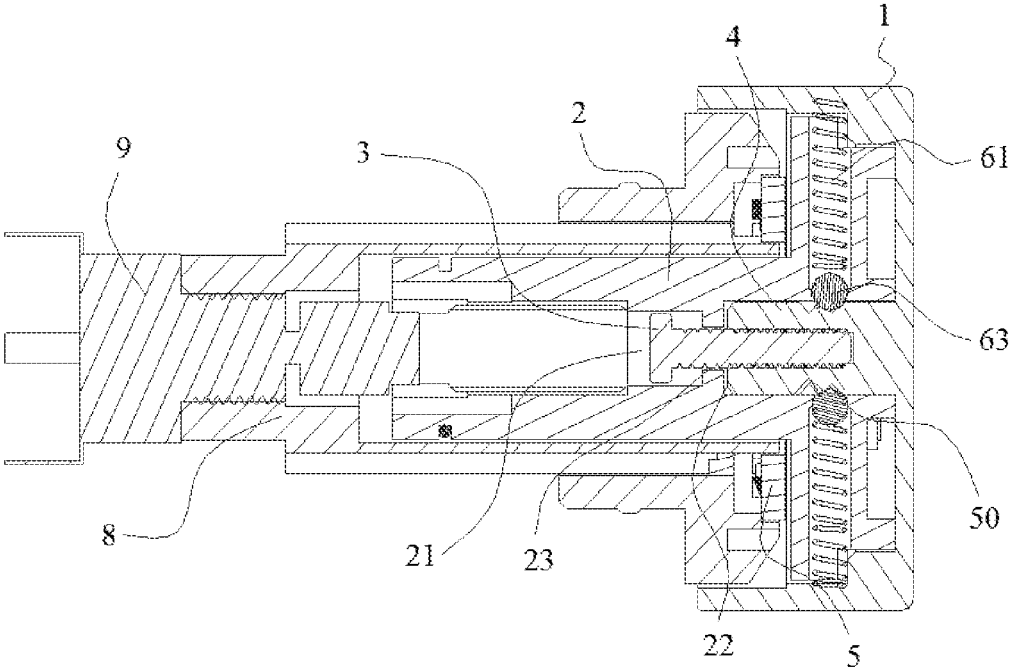
FIG. 1 shows a first operating mode of a knob switch device according to a first embodiment of the present disclosure.

Reference numerals in drawings of the knob switch device in the present disclosure are described as follows.

| | | |
|---|---|---|
| 1-knob | 2-rotating shaft sleeve | 3-limit screw |
| 4-extension part | 5-switching element | 6-control rod |
| 7-distance sensor | 8-fixed shaft sleeve | 9-encoder |
| 21-front channel | 22-rear channel | 23-connecting channel |
| 30-first magnetic unit | 40-second magnetic unit | 50-clamping slot |
| 61-spring | 62-spring piece | 63-clamping element |
| 70-top pressing element | 81-signal transmitting terminal | 82-signal receiving terminal |
| 90-shielding ring | | |

DETAILED DESCRIPTION OF EMBODIMENTS

The present disclosure describes an improved structure applied to a knob switch device, which mainly refers to a design of a trigger mechanism and its specific application. For illustrative purposes, the present disclosure is applied to intelligent sanitary devices (an intelligent pedestal pan is selected in the present disclosure) for example, but the application scope of the present disclosure is not limited.

The knob switch device, as shown in FIG. 1 to FIG. 12, includes a knob 1, a rotating shaft sleeve 2, a PCB (which is not shown in the drawings), a switching element 5, a fixed shaft sleeve 8 and an encoder 9. The rotating shaft sleeve 2 is fixedly connected to the knob 1. The knob 1 can be arranged separately or integratedly with the knob 1. The rotating shaft sleeve 2 has a hollow structure, there are two channels (a front channel 21 and a rear channel 22) in the rotating shaft sleeve 2, and the two channels (the front channel 21 and the rear channel 22) are connected by a connecting channel 23. An extension part 4 of the knob 1 is inserted into the rear channel 22, a limit screw 3 extends from the front channel 21 into the rear channel 22 through the connecting channel 23, and the limit screw 3 is inserted into the extension part 4 of the knob 1 with threaded connection. The knob 1 is clamped and fixedly connected to a rear of the rotating shaft sleeve 2. The fixed shaft sleeve 8 is sleeved on the outside of the rotating shaft sleeve 2, an end of the encoder 9 is inserted into the fixed shaft sleeve 8 and extends to the front channel 21 of the rotating shaft sleeve 2, and the end of the encoder 9 abuts against an end of the fixed shaft sleeve 8 by threaded connection. A circular PCB (which is not shown in the drawings) is sleeved on the outside of the rotating shaft sleeve 2 and is arranged between the rotating shaft sleeve 2 and a rotation part of the knob 1. The switching element 5 is installed on the PCB (which is not shown in the drawings) and connected to a printed circuit on the PCB (which is not shown in the drawings). The knob 1 can rotate steplessly, and transform a change in a mechanical rotation angle into an electrical signal by the encoder 9 through a control circuit printed on the PCB (which is not shown in the drawings).

In the present disclosure, it is only needed to touch the knob 1 lightly when operating, the trigger mechanism is driven by an action of lightly touching or pushing and pulling, different user manipulation information is sent to an MCU which is directly or indirectly connected. The MCU controls the corresponding circuit to achieve functions of the intelligent pedestal pan according to the information, and thus realizes the switching between the different functions of the knob switch device after the operation. The operation can be completed in one step without resetting or returning to zero or remembering the previous operation state after the user's operation.

First Embodiment

Figure 2:
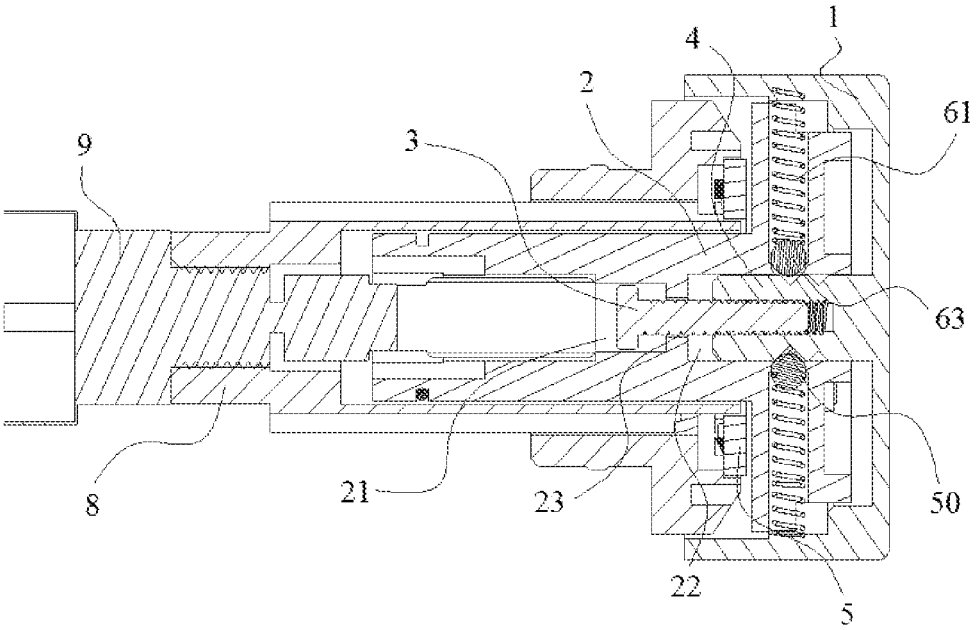
FIG. 2 shows a second operating mode of the knob switch device according to the first embodiment of the present disclosure.

In the present disclosure, a trigger mechanism includes a clamping unit and a clamping slot 50 (in this embodiment, two of the clamping slots 50 are arranged at intervals, and the clamping slots 50 are connected to the outside of an extension part 4 of a knob 1 to form an end-to-end circular orbit) in cooperation with each other. As shown in FIG. 1 and FIG. 2, the clamping unit is a kind of a flexible structure, which includes an elastic element (a spring 61 in this embodiment) and a clamping element 63 arranged at an end of the elastic element (the spring 61 in this embodiment). One end of the spring 61 is fixed on an inner wall of the knob 1, and the other end of the spring 61 extends toward the extension part 4 of the knob 1. A length of the spring 61 can meet the requirement of getting into and signing out from the clamping slot 50 for the clamping element 63, and elasticity of the spring 61 should ensure a certain intensity, namely, the clamping element 63 will not sign out or slip out from the clamping slot 50 easily (non-artificially) after the clamping element 63 is inserted into the clamping slot 50. The clamping element 63 is installed on a non-fixed end of the spring 61, and a shape of the clamping element 63 is matched with a shape of a cross section of the clamping slot 50. It should be noted that, the clamping slot 50 and the clamping element 63 may have any shape, so long as the clamping element 63 can be conveniently inserted into the clamping slot 50 and positioned, and can sign out easily. The shape of the clamping slot 50 and the clamping element 63 is not limited to the above shape, and the application scope of the present disclosure is not limited.

In a first operating mode, the clamping element 63 is placed in a first clamping slot 50 by the spring 61, and the clamping element 63 can maintain such a state under the elastic force of the spring 61. In this way, the knob switch device is in the first operating mode. The knob 1 can rotate steplessly in the first operating mode, and transform a change in a mechanical rotation angle into an electrical signal. In this case, the clamping element 63 slides in the circular orbit formed by the clamping slot 50. Because the shape of the clamping element 63 is matched with a shape of a cross section of the first clamping slot 50, the clamping element 63 will not sign out or slide out from the clamping slot 50 during a rotation process of the knob 1, thereby ensuring the stability of the rotation.

In a second operating mode, an outer edge of the clamping element 63 signs out from the inner wall of the first clamping slot 50 when the knob 1 is pressed inward, and the clamping element 63 slides under a force of pressing until a second clamping slot 50 is reached. The clamping element 63 is placed in the second clamping slot 50 by the spring 61, and the clamping element 63 can maintain such a state under the elastic force of the spring 61. At the same time, the switching element 5 is also pressed and switched to the second operating mode. In this way, the knob switch device is in the second operating mode. The knob 1 can rotate steplessly in the second operating mode, and transform a change in a mechanical rotation angle into an electrical signal. In this case, the clamping element 63 slides in the circular orbit formed by the clamping slot 50. Because the shape of the clamping element 63 is also matched with the shape of the cross section of the clamping slot 50, the clamping element 63 will not sign out or slide out from the clamping slot 50 during the rotation process of the knob 1, thereby ensuring the stability of the rotation.

In order to switch between different operating modes, the knob 1 is pressed and pulled, such that the knob switch device is switched between the two different operating modes and is positioned by the trigger mechanism. The encoder can be driven by the knob to transform a change in a mechanical angle into an electrical signal and send the electrical signal to a connected main MCU, and the main MCU can control the intelligent pedestal pan to realize the corresponding functions after receiving the control information.

Second Embodiment

Figure 3:
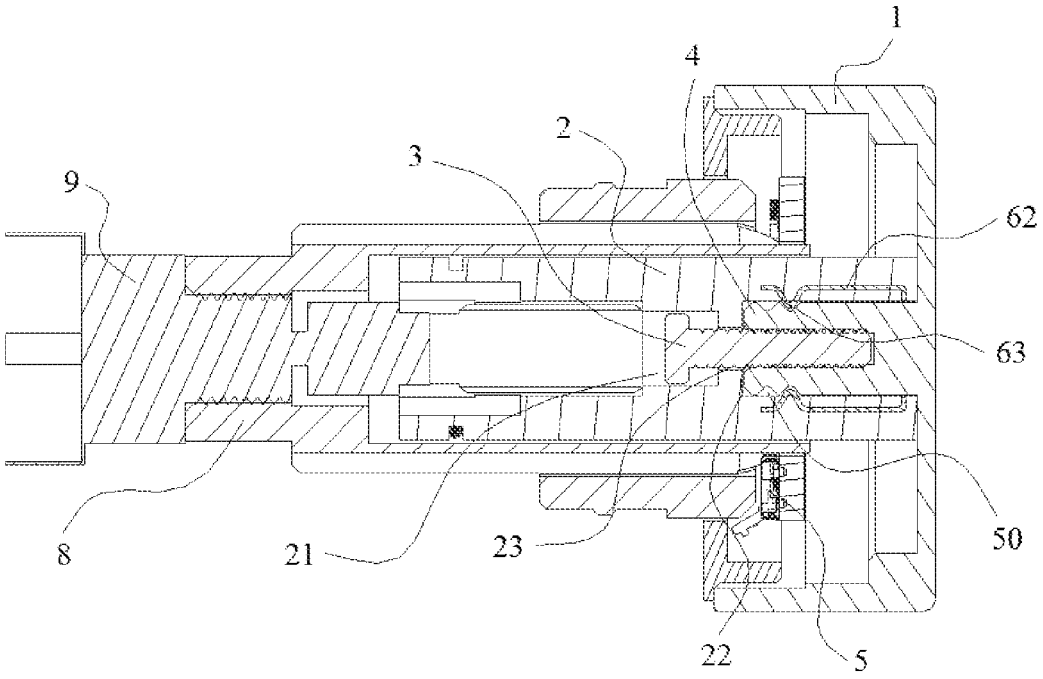
FIG. 3 shows a first operating mode of a knob switch device according to a second embodiment of the present disclosure.
Figure 4:
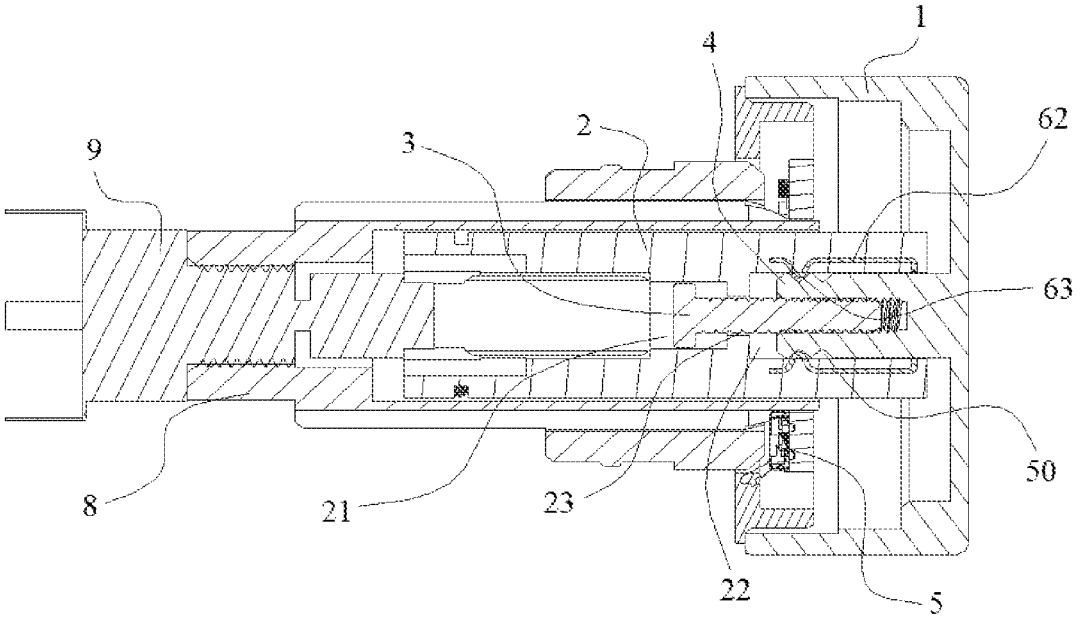
FIG. 4 shows a second operating mode of the knob switch device according to the second embodiment of the present disclosure.

In the present disclosure, a trigger mechanism includes a clamping unit and a clamping slot 50 (in this embodiment, two of the clamping slots 50 are arranged at intervals, and the clamping slots 50 are connected to the outside of an extension part 4 of a knob 1 to form an end-to-end circular orbit) in cooperation with each other. As shown in FIG. 3 and FIG. 4, the clamping unit is a kind of a flexible structure, which includes an elastic element (a spring piece 62 in this embodiment) and a clamping element 63 arranged at the end of the elastic element (the spring piece 62 in this embodiment). One end of the spring piece 62 is fixed on the outside of the extension part 4 of the knob 1, and the other end of the spring piece 62 extends in an axial direction of the extension part 4 of the knob 1. The length of the spring piece 62 can meet the requirement of getting into and signing out from the clamping slot 50 for the clamping element 63, and the elastic force of the spring piece 62 should ensure a certain intensity, namely, the clamping element 63 will not sign out or slip out from the clamping slot 50 easily (non-artificially) after the clamping element 63 is inserted into the clamping slot 50. The clamping element 63 is installed on a non-fixed end of the spring piece 62, and the shape of the clamping element 63 is matched with the shape of the cross section of the clamping slot 50. It should be noted that, the clamping slot 50 and the clamping element 63 may have any shape, so long as the clamping element 63 can be conveniently inserted into the clamping slot 50 and positioned, and can sign out easily. The shape of the clamping slot 50 and the clamping element 63 is not limited to the above shape, and the application scope of the present disclosure is not limited.

In a first operating mode, the clamping element 63 is placed in a clamping slot 50 by the spring piece 62, and the clamping element 63 can maintain such a state under the elastic force of the spring piece 62. In this way, the knob switch device is in the first operating mode. The knob 1 can rotate steplessly in the first operating mode, and transform a change in a mechanical rotation angle into an electrical signal. The clamping element 63 slides in the circular orbit formed by the clamping slot 50. Because the shape of the clamping element 63 is also matched with the shape of the cross section of the clamping slot 50, the clamping element 63 will not sign out or slip out from the clamping slot 50 during the rotation process of the knob 1, thereby ensuring the stability of the rotation.

In a second operating mode, an outer edge of the clamping element 63 signs out from the inner wall of the first clamping slot 50 when the knob 1 is pressed inward, and the clamping element 63 slides under an external force until a second clamping slot 50 is reached. The clamping element 63 is placed in the second clamping slot 50 by the spring piece 62, and the clamping element 63 can maintain such a state under the elastic force of the spring piece 62. At the same time, the switching element 5 is also pressed and switched to the second operating mode. In this way, the knob switch device is in the second operating mode. The knob 1 can rotate steplessly in the second operating mode, and transform a change in a mechanical rotation angle into an electrical signal. In this case, the clamping element 63 slides in the circular orbit formed by the clamping slot 50. Because the shape of the clamping element 63 is also matched with the shape of the cross section of the clamping slot 50, the clamping element 63 will not sign out or slip out from the clamping slot 50 during the rotation process of the knob 1, thereby ensuring the stability of the rotation.

In order to switch between different operating modes, the knob 1 is pressed and pulled, such that the knob switch device is switched between the two different operating modes and is positioned by the trigger mechanism. The encoder can be driven by the knob to transform a change in a mechanical angle into an electrical signal and send the electrical signal to the connected main MCU, and the main MCU can control the intelligent pedestal pan to realize the corresponding functions after receiving the control information.

Third Embodiment

Figure 5:
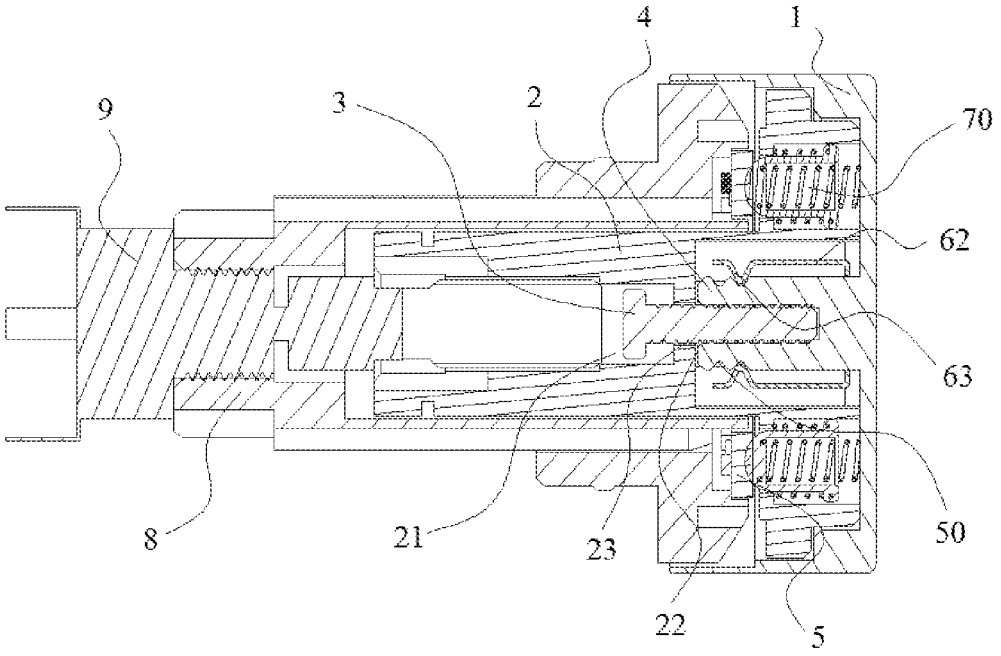
FIG. 5 shows a first operating mode of a knob switch device according to a third embodiment of the present disclosure.
Figure 6:
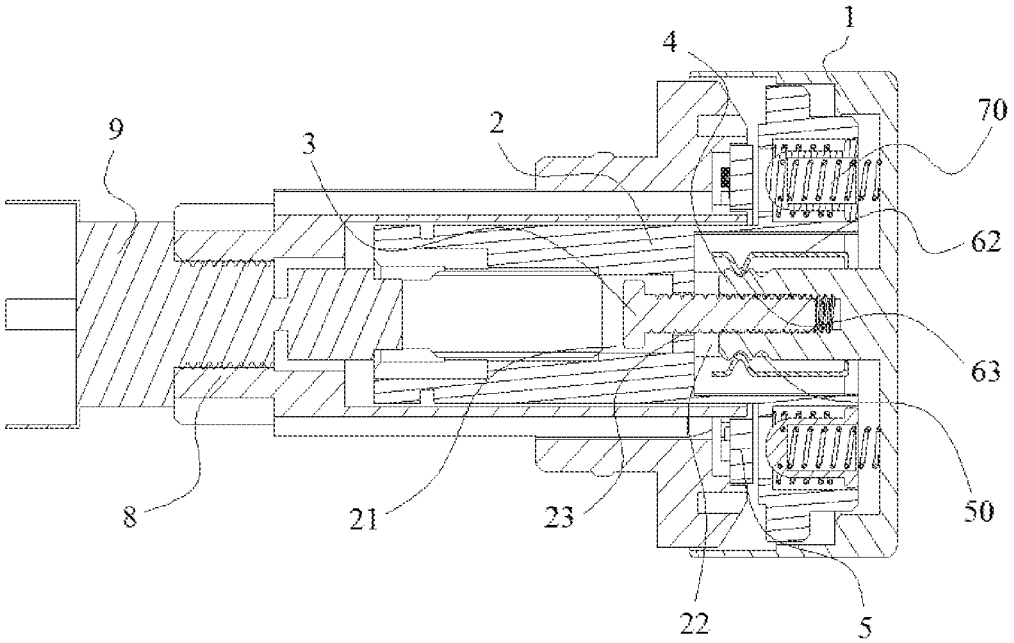
FIG. 6 shows a second operating mode of the knob switch device according to the third embodiment of the present disclosure.

In the present disclosure, a trigger mechanism includes a clamping unit and a clamping slot 50 (in this embodiment, the clamping slot 50 is connected to the outside of an extension part 4 of a knob 1 to form an end-to-end circular orbit) in cooperation with each other. As shown in FIG. 5 and FIG. 6, the clamping unit is a kind of a flexible structure, which includes an elastic element (a spring piece 62 in this embodiment) and a clamping element 63 arranged at the end of the elastic element (the spring piece 62 in this embodiment). One end of the spring piece 62 is fixed on the outside of the extension part 4 of the knob 1, and the other end of the spring piece 62 extends in an axial direction of the extension part 4 of the knob 1. The length of the spring piece 62 can meet the requirement of getting into and signing out from the clamping slot 50 for the clamping element 63, and the elastic force of the spring piece 62 should ensure a certain intensity, namely, the clamping element 63 will not sign out or slip out from the clamping slot 50 easily (non-artificially) after the clamping element 63 is inserted into the clamping slot 50. The clamping element 63 is installed on the non-fixed end of the spring piece 62, and the shape of the clamping element 63 is matched with the shape of the cross section of the clamping slot 50. It should be noted that, the clamping slot 50 and the clamping element 63 may have any shape, so long as the clamping element 63 can be conveniently inserted into the clamping slot 50 and positioned, and can sign out easily. The shape of the clamping slot 50 and the clamping element 63 is not limited to the above shape, and the application scope of the present disclosure is not limited.

In a first operating mode, the clamping element 63 is placed in a clamping slot 50 by the spring piece 62, and the clamping element 63 can maintain such a state under the elastic force of the spring piece 62. In this way, the knob switch device is in the first operating mode, and the switching element 5 is not pressed by a top pressing element 70 longitudinally arranged on the inner wall of the knob 1. The knob 1 can rotate steplessly in the first operating mode, and transform a change in a mechanical rotation angle into an electrical signal. In this case, the clamping element 63 slides in the circular orbit formed by the clamping slot 50. Because the shape of the clamping element 63 is also matched with the shape of the cross section of the clamping slot 50, the clamping element 63 will not sign out or slip out from the clamping slot 50 during the rotation process of the knob 1, thereby ensuring the stability of the rotation.

In a second operating mode, the outer edge of the clamping element 63 signs out from the inner wall of the first clamping slot 50 when the knob 1 is pressed inward, and the clamping element 63 slides under an external force until a second clamping slot 50 is reached. The clamping element 63 is placed in the second clamping slot 50 by the spring piece 62, and the clamping element 63 can maintain such a state under the elastic force of the spring piece 62. At the same time, the switching element 5 is also pressed by the top pressing element 70 longitudinally arranged on the inner wall of the knob 1, and is switched from the first operating mode to the second operating mode. The knob 1 can rotate steplessly in the second operating mode, and transform a change in a mechanical rotation angle into an electrical signal. In this case, the clamping element 63 slides in the circular orbit formed by the clamping slot 50. Because the shape of the clamping element 63 is also matched with the shape of the cross section of the clamping slot 50, the clamping element 63 will not sign out or slip out from the clamping slot 50 during the rotation process of the knob 1, thereby ensuring the stability of the rotation.

In order to switch between different operating modes, the knob 1 is pressed and pulled, such that the knob switch device is switched between the two different operating modes and is positioned by the trigger mechanism. The encoder can be driven by the knob to transform a change in a mechanical angle into an electrical signal and send the electrical signal to the connected main MCU, and the main MCU can control the intelligent pedestal pan to realize the corresponding functions after receiving the control information.

Fourth Embodiment

In the present disclosure, a trigger mechanism includes a first magnetic unit 30 and a second magnetic unit 40 in cooperation with each other. The first magnetic unit 30 and the second magnetic unit 40 are both circular, which are sleeved on the outside of a fixed shaft sleeve 8, and the two magnetic units are arranged at intervals between a knob part of a knob 1 and the PCB (which is not shown in the drawings). The second magnetic unit 40 is fixed in the knob 1, and can move with the push-pull of the knob 1. The first magnetic unit 30 is installed in the fixed shaft sleeve 8 and is not fixed. Therefore, the first magnetic unit 30 can move in the fixed shaft sleeve 8. It should be noted that, the fixed mode of the first magnetic unit 30 and the second magnetic 40 is not limited to the above connection mode, and the application scope of the present disclosure is not limited.

Since a magnetic pole of the first magnetic unit 30 and a magnetic pole of the second magnetic unit 40 are arranged in homopolarity, there is a repulsion force between the two magnetic units. In a case of no external force, a distance between the first magnetic unit 30 and the second magnetic unit 40 is relatively fixed because of the repulsion force.

Figure 7:
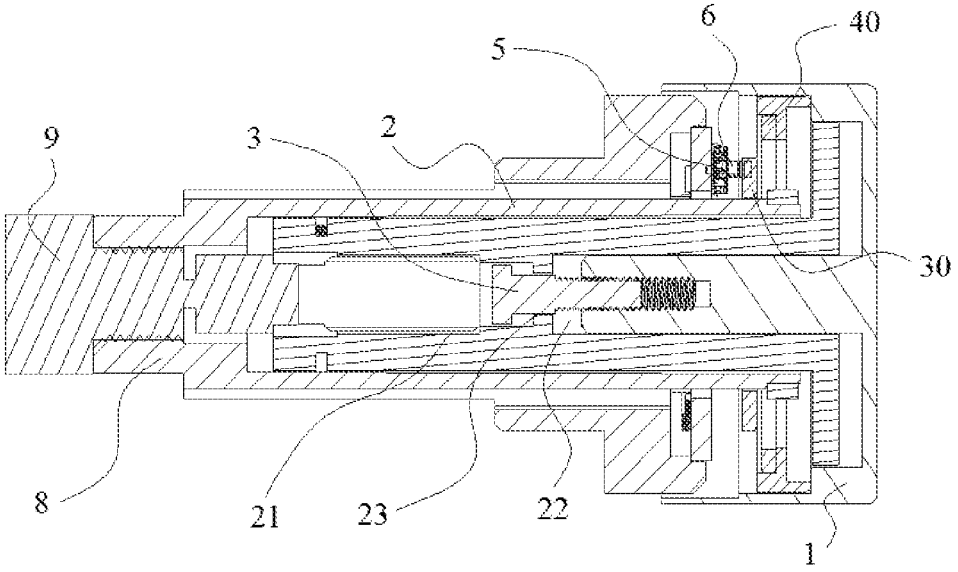
FIG. 7 shows a first operating mode of a knob switch device according to a fourth embodiment of the present disclosure.

In a first operating mode, the distance between the first magnetic unit 30 and the second magnetic unit 40 is relatively far, the first magnetic unit 30 is attached to a switching element 5 which is arranged on one side of the first magnetic unit 30, and the first magnetic unit 30 presses a control rod 6 of the switching element 5, as shown in FIG. 7. The control rod 6 exerts a pressure on the switching element 5, such that the switching element 5 is in the first operating mode, and the knob 1 can rotate steplessly in the first operating mode and transform a change in a mechanical rotation angle into an electrical signal.

In a second operating mode, under an external force (pushing by a user with a hand) which is acted on the knob 1, the second magnetic unit 40 moves toward the first magnetic unit 30, and the first magnetic unit 30 moves toward the second magnetic unit 40 correspondingly. The distance between the two magnetic units gets closer and closer, such that the switching element 5 remains in the first operating mode. When exceeding the critical state, that is, when the first magnetic unit 30 and the second magnetic unit 40 are interlaced, a direction of a force acted on the first magnetic unit 30 by the second magnetic unit 40 is changed, that is, rotating 180 degrees relative to the original direction. Under the action of a mutual repulsion force, the first magnetic unit 30 moves toward a direction far away from the second magnetic unit 40, and the distance between the first magnetic unit 30 and the switching element 5 which is located on one side of the first magnetic unit 30 gets farther and farther at the same time. In this case, the pressure which is acted on the control rod 6 of the switching element 5 by the first magnetic unit 30 is reduced, which results in the decrease of the pressure exerted on the switching element 5 by the control rod 6. When the pressure exceeds a critical value, the switching element 5 is switched to the second operating mode, and the knob 1 can rotate steplessly in the second operating mode and transform a change in a mechanical rotation angle into an electrical signal. On the contrary, it is switched from the second operating mode to the first operating mode if the knob 1 is pulled.

Figure 8:
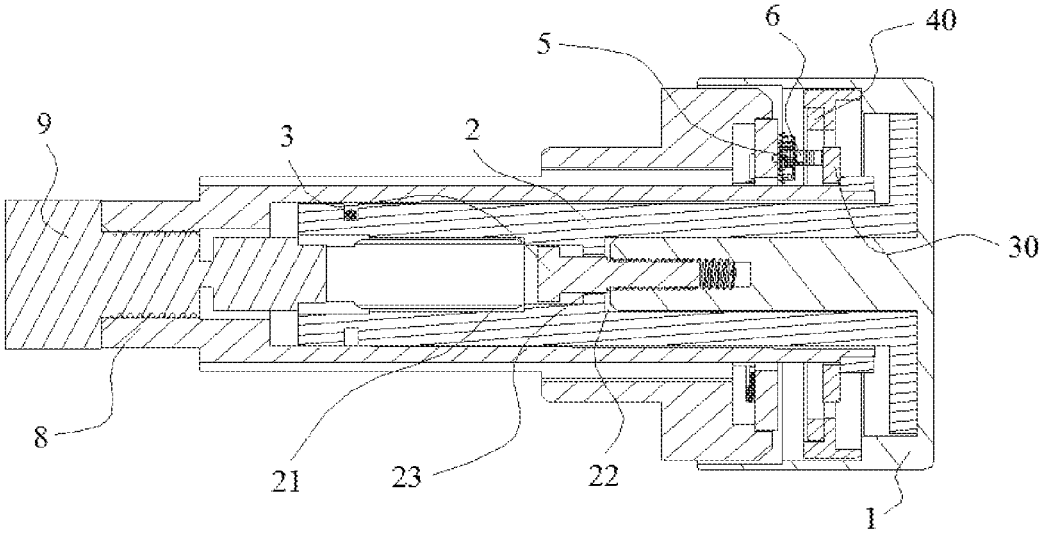
FIG. 8 shows a second operating mode of the knob switch device according to the fourth embodiment of the present disclosure.

To facilitate switching between the two operating modes, an outer diameter of the first magnetic unit 30 is set to be less than an inner diameter of the second magnetic unit 40 in the knob switch device according to the present disclosure, so that the first magnetic unit 30 can enter the second magnetic unit 40 and pass through the second magnetic unit 40 (as shown in FIG. 8) to achieve the effect of switching the operating mode.

Further, in the process of position changing between the first magnetic unit 30 and the second magnetic unit 40, it is needed to overcome the repulsion force between the magnets, which will result in a change of the repulsion force between the two magnetic units. The operating force is called "knob hand feeling". The operating force can be changed by adjusting the magnetic intensity, such that the user can perceive the switching of the operating mode of the switching element 5 from a hand feeling (changes in the direction of the repulsion force) by such a change. In this way, there is no mechanical resistance or friction, and the good hand feeling improves the user experience, and the service life of the device is effectively extended.

Furthermore, since the outer diameter of the first magnetic unit 30 is set to be smaller than the inner diameter of the second magnetic unit 40, the first magnetic unit 30 can move reciprocally in an inner ring of the second magnetic unit 40. That is, the switching element 5 is switched on or off by pushing and pulling the knob 1 by the hand of the user, to switch between the two operating modes. The encoder can be driven by the knob to transform a change in a mechanical angle into an electrical signal and send the electrical signal to the connected main MCU, and the main MCU can control the intelligent pedestal pan to realize the corresponding functions after receiving the control information.

The trigger mechanism pushes and pulls the knob by using the magnetic positive and negative poles, and switches on or off the switch in the process of pushing and pulling. Different user manipulation information is sent to the MCU which is directly or indirectly connected to the device, and the MCU controls the corresponding circuit to achieve functions of the intelligent pedestal pan according to the information. In addition, by taking advantage of the characteristics that there is no mechanical resistance or friction for the magnetic force in the process of pushing and pulling, the following case can be effectively avoided. The contact-type switch and the inside of the knob are in a top touch state for long time in the process of rotating the knob, and thus the switch is insensitive and is easy to wear. Besides, based on the above characteristics of the magnetic force, on one hand, a good hand feeling can improve the user experience; and on the other hand, the service life of the device can be extended.

Fifth Embodiment

In the present disclosure, a trigger mechanism includes a first magnetic unit 30 and a second magnetic unit 40 in cooperation with each other. The first magnetic unit 30 and the second magnetic unit 40 are both circular, which are sleeved on the outside of a fixed shaft sleeve 8, and the two magnetic units are arranged at intervals between a knob part of a knob 1 and the PCB (which is not shown in the drawings). The second magnetic unit 40 is fixed in the knob 1, and can move with the push-pull of the knob 1. The first magnetic unit 30 is installed in the fixed shaft sleeve 8 and is not fixed. Therefore, the first magnetic unit 30 can move in the fixed shaft sleeve 8. It should be noted that, the fixed mode of the first magnetic unit 30 and the second magnetic unit 40 is not limited to the above connection mode, and the application scope of the present disclosure is not limited.

Since a magnetic pole of the first magnetic unit 30 and a magnetic pole of the second magnetic unit 40 are arranged in homopolarity, there is a repulsion force between the two magnetic units. In a case of no external force, the distance between the first magnetic unit 30 and the second magnetic unit 40 is relatively fixed because of the repulsion force.

Figure 9:
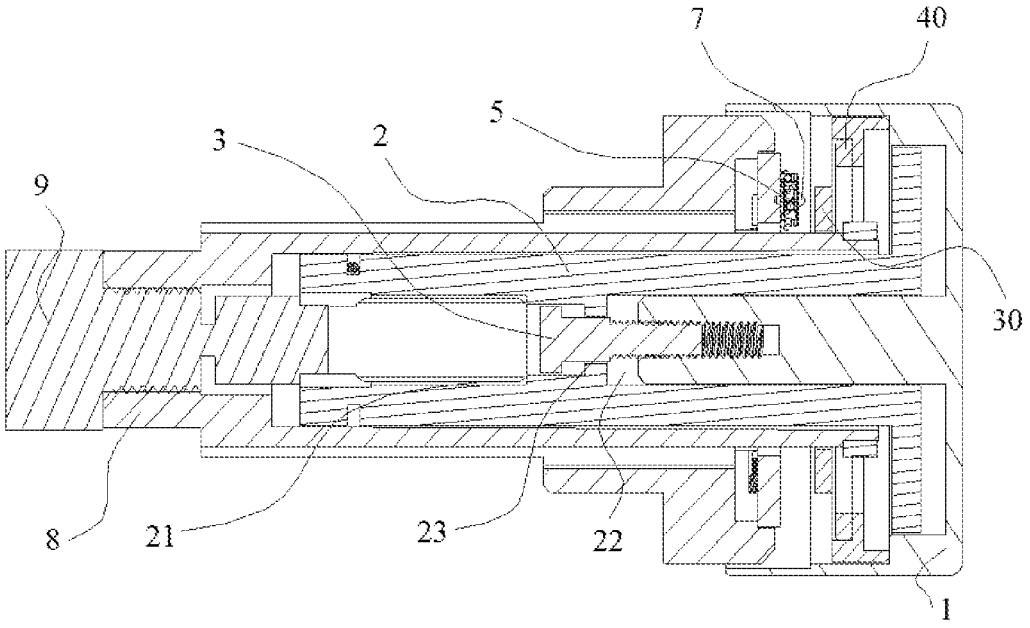
FIG. 9 shows a first operating mode of a knob switch device according to a fifth embodiment of the present disclosure.

In a first operating mode, the distance between the first magnetic unit 30 and the second magnetic unit 40 is relatively far, the first magnetic unit 30 approaches to a switching element 5 which is arranged on one side of the first magnetic unit 30, and a distance sensor 7 on the switching element 5 can perceive the distance between the first magnetic unit 30 and the switching element 5 which is arranged on one side of the first magnetic unit 30 (relatively close), as shown in FIG. 9. In this case, the switching element 5 is in the first operating mode, and the knob 1 can rotate steplessly in the first operating mode and transform a change in a mechanical rotation angle into an electrical signal.

In a second operating mode, under an external force (pushing by a user with a hand) which is acted on the knob 1, the second magnetic unit 40 moves toward the first magnetic unit 30, and the first magnetic unit 30 moves toward the second magnetic unit 40 correspondingly. The distance between the two magnetic units gets closer and closer, such that the switching element 5 remains in the first operating mode. When exceeding the critical state, that is, when the first magnetic unit 30 and the second magnetic unit 40 are interlaced, the direction of the force acted on the first magnetic unit 30 by the second magnetic unit 40 is changed, that is, rotating 180 degrees relative to the original direction. Under the action of the mutual repulsion force, the first magnetic unit 30 moves toward the direction far away from the second magnetic unit 40, and the distance between the first magnetic unit 30 and the switching element 5 which is arranged on one side of the first magnetic unit 30 gets farther and farther at the same time. The distance sensor 7 can perceive the change of the distance between the first magnetic unit 30 and the switching element 5 on one side. When exceeding a critical value, the switching element 5 is switched to the second operating mode, and the knob 1 can rotate steplessly in the second operating mode and transform a change in a mechanical rotation angle into an electrical signal. On the contrary, it is switched from the second operating mode to the first operating mode if the knob 1 is pulled.

Figure 10:
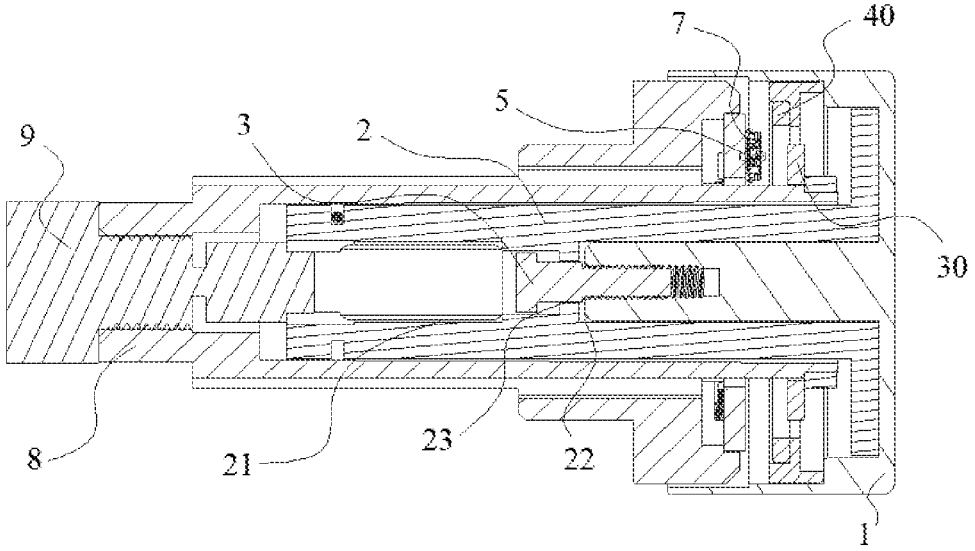
FIG. 10 shows a second operating mode of the knob switch device according to the fifth embodiment of the present disclosure.

To facilitate switching between the two operating modes, an outer diameter of the first magnetic unit 30 is set to be less than an inner diameter of the second magnetic unit 40 in the knob switch device according to the present disclosure, so that the first magnetic unit 30 can enter the second magnetic unit 40 and pass through the second magnetic unit 40 (as shown in FIG. 10) to achieve the effect of switching the operating mode.

Further, in the process of position changing between the first magnetic unit 30 and the second magnetic unit 40, it is needed to overcome the repulsion force between the magnets, which will result in a change of the repulsion force between the two magnetic units, and the operating force is called "knob hand feeling". The operating force can be changed by adjusting the magnetic intensity, such that the user can perceive the switching of the operating mode of the switching element 5 from a hand feeling (changes in the direction of the repulsion force) by such a change. In this way, there is no mechanical resistance or friction, the good hand feeling improves the user experience, and the service life of the device is effectively extended.

Furthermore, since the outer diameter of the first magnetic unit 30 is set to be smaller than the inner diameter of the second magnetic unit 40, the first magnetic unit 30 can move reciprocally in an inner ring of the second magnetic unit 40. That is, the switching element 5 is switched on or off by pushing and pulling the knob 1 by the hand of the user, to switch between the two operating modes. The encoder can be driven by the knob to transform a change in a mechanical angle into an electrical signal and send the electrical signal to the connected main MCU, and the main MCU can control the intelligent pedestal pan to realize the corresponding functions after receiving the control information.

The trigger mechanism pushes and pulls the knob by using the magnetic positive and negative poles, and switches on or off the switch in the process of pushing and pulling. Different user manipulation information is sent to the MCU which is directly of in directly connected to the device, and the MCU controls the corresponding circuit to achieve functions of the intelligent pedestal pan according to the information. In addition, by taking advantage of the characteristics that there is no mechanical resistance or friction for the magnetic force in the process of pushing and pulling, the following case can be effectively avoided. The contact-type switch and the inside of the knob are in a top touch state for long time in the process of rotating the knob, and thus the switch is insensitive and is easy to wear. Besides, based on the above characteristics of the magnetic force, on one hand, a good hand feeling can improve the user experience; and on the other hand, the service life of the device can be extended.

Sixth Embodiment

Figure 11:
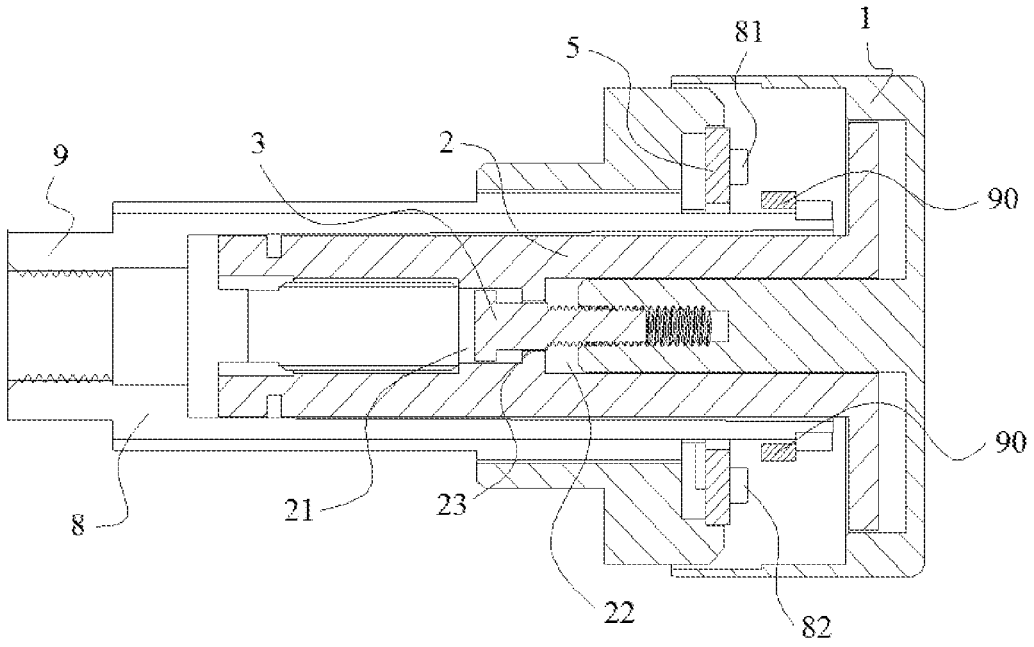
FIG. 11 shows a first operating mode of a knob switch device according to a sixth embodiment of the present disclosure.
Figure 12:
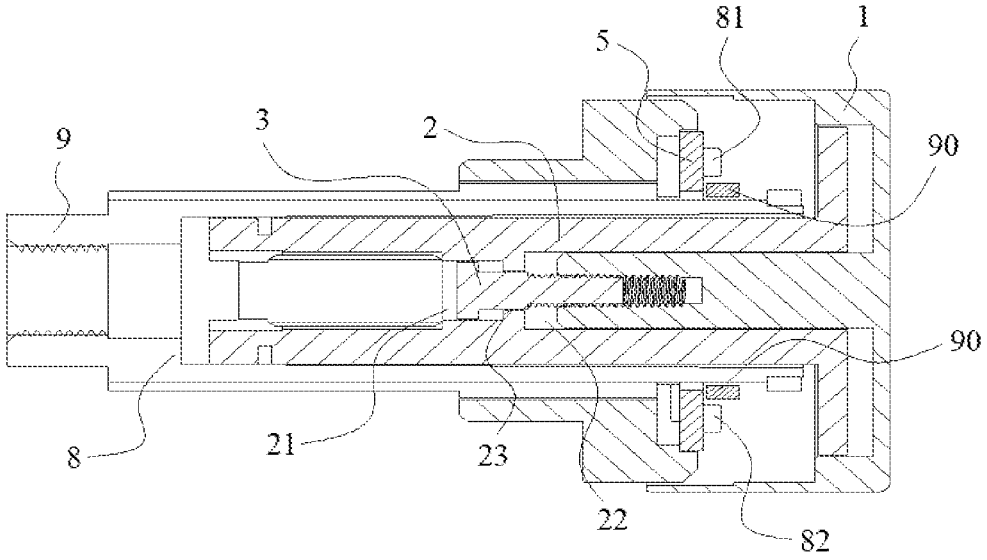
FIG. 12 shows a second operating mode of the knob switch device according to the sixth embodiment of the present disclosure.

The trigger mechanism in the present disclosure is a shielding ring 90. As shown in FIG. 11 and FIG. 12, the switching element 5 is provided with a signal transmitting terminal 81 and a signal receiving terminal 82 (a signal may be but not limited to optocoupler, infrared or ray) which are arranged oppositely. It should be noted that, in order to make the signal transmitting terminal 81 and the signal receiving terminal 82 send and receive signals normally, a fixed shaft sleeve 8 should not affect the positions of the signal transmitting terminal 81 and the signal receiving terminal 82 on the switching element 5, the size of the fixed shaft sleeve 8 should meet the requirement for sending and receiving signals normally, and the signal transmitting terminal 81 and the signal receiving terminal 82 are not shielded. In addition, the shielding ring 90 is also sleeved on the outside of the fixed shaft sleeve 8, is arranged coaxially with the switching element 5, and a radius of the shielding ring 90 is less than a radius of the switching element 5.

Figure 13:
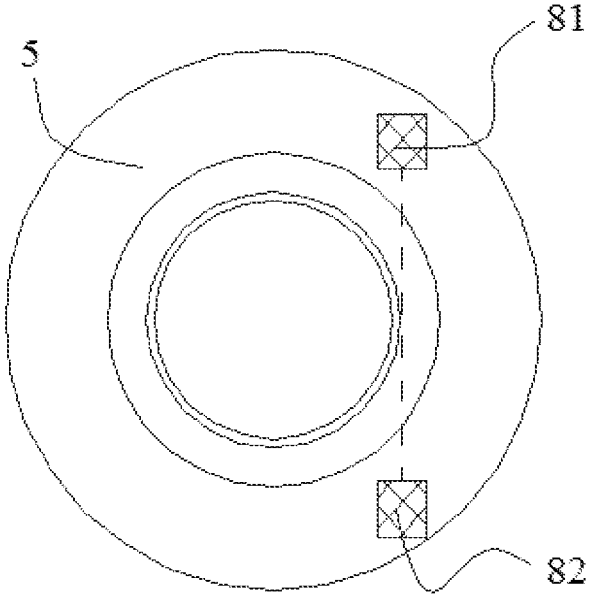
FIG. 13 shows a signal-on-state of the knob switch device according to the sixth embodiment of the present disclosure.

As shown in FIG. 13, in a first operating mode, the switching element 5 is provided with a signal transmitting terminal 81 and a signal receiving terminal 82 (a signal may be but not limited to optocoupler, infrared or ray) which are arranged oppositely without any shelter. In this case, the signal transmitting terminal 81 and the signal receiving terminal 82 can send and receive signals normally, and the positions of the signal transmitting terminal 81 and the signal receiving terminal 82 on the switching element 5 are not affected by the fixed shaft sleeve 8. The switching element 5 is in the first operating mode, the knob 1 can rotate steplessly and transform a change in a mechanical rotation angle into an electrical signal.

Figure 14:
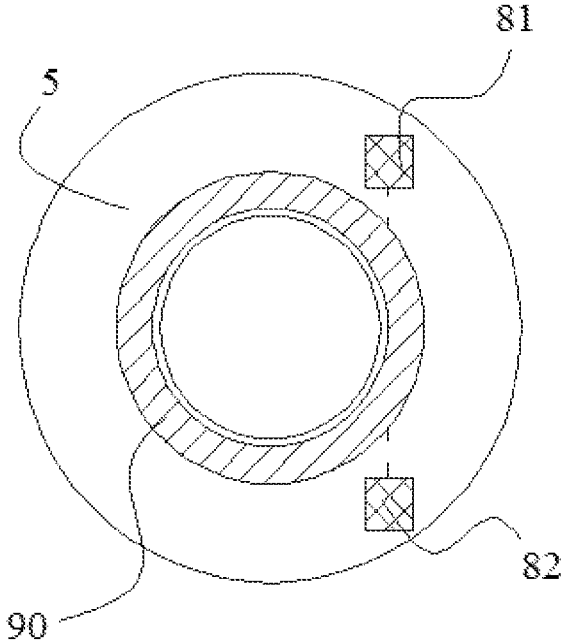
FIG. 14 shows a signal-off-state of the knob switch device according to the sixth embodiment of the present disclosure.

In a second operating mode, as shown in FIG. 14, the shielding ring 90 which is sleeved on the outside of the fixed shaft sleeve 8 moves downward, and the shielding ring 90 is blocked and positioned by the switching element 5 when it falls onto the switching element 5. In this case, an arc-shaped section of the shielding ring 90 extends to a position between the signal transmitting terminal 81 and the signal receiving terminal 82. It should be noted that the physical parameters such as a thickness and a height of the shielding ring 90 should meet the requirement of shielding signals. In this case, the arc-shaped section between the signal transmitting terminal 81 and the signal receiving terminal 82 blocks the normal signal transmission and receiving between the signal transmitting terminal 81 and the signal receiving terminal 82, thereby blocking the signal. That is, the switching element 5 is switched to the second operating mode, the knob 1 can rotate steplessly and transform a change in a mechanical rotation angle into an electrical signal.

The knob switch device can be switched between two different modes based on whether the signal between the signal transmitting terminal 81 and the signal receiving terminal 82 is blocked. The encoder is driven by the knob to transform a change in a mechanical angle into an electrical signal and send the electrical signal to the connected main MCU, and the main MCU can control the intelligent pedestal pan to realize the corresponding functions after receiving the control information.

It is known from the description of the present disclosure that, the present disclosure has the following advantages.

1. With the knob switch device in the present disclosure, a change in a mechanical rotation angle is transformed into an electrical signal by rotating the knob, and the functional mode of the intelligent pedestal pan is switched by pressing or pulling the knob in the axial direction. In this way, the multiple functions of the intelligent pedestal pan are flexibly controlled by using a single knob, and the knob switch device has a compact and small structure, thereby shortening the distance between a person and the intelligent pedestal pan.

2. Components in the knob portion are connected together by the rotating shaft sleeve and the fixed shaft sleeve, such that the whole knob portion has a compact and small structure.

3. The trigger mechanism brings good hand feeling and has a simple and reliable structure by cooperation between the clamping slots and the clamping element.

4. With the cooperation of the first magnetic unit and the second magnetic unit in the trigger mechanism and the characteristics that there is no mechanical resistance and friction for the magnetic force during the pushing and pulling process, the following case can be effectively avoided. The contact-type switch and the inside of the knob are in a top touch state for long time in the rotation operation of the knob, and thus the switch is insensitive and is easy to wear. Furthermore, based on the characteristics of the magnetic force, a good hand feeling is generated when pressing or pulling the knob and the service life of the knob is long.

5. It is switched between two different modes based on whether the signal between the signal transmitting terminal and the signal receiving terminal is blocked, and the structure is simple and reliable.

Although the present disclosure is disclosed by preferred embodiments above, and the preferred embodiments are not used to limit the present disclosure. Possible modifications and improvements can be made to the technical solution of the present disclosure by those skilled in the art based on the disclosed method and technical content without departing from the spirit and scope of the present disclosure. Any simple changes and equivalent modifications made based on the technical essence of the present disclosure without departing from the content of the technical solutions of the present disclosure should fall within the protection scope of the technical solutions of the present disclosure.

INDUSTRIAL APPLICABILITY

With the knob switch device in the present disclosure, a change in a mechanical rotation angle is transformed into an electrical signal by rotating the knob, and the functional mode of the intelligent pedestal pan is switched by pressing or pulling the knob in the axial direction. In this way, the multiple functions of the intelligent pedestal pan are flexibly controlled by using a single knob, and the knob switch device has a compact and small structure, thereby shortening the distance between the person and the intelligent pedestal pan.

The invention claimed is:

1. A knob switch device, comprising:

a knob portion comprising a knob configured to control an encoder; and a control circuit portion electrically connected to the encoder and at least one switching element, wherein the knob portion further comprises a trigger mechanism configured to trigger the switching element, and the knob drives the trigger mechanism to trigger the switching element by an axial movement, wherein the knob portion comprises a rotating shaft sleeve and a fixed shaft sleeve sleeved on outside of the rotating shaft sleeve, the knob is fixedly connected to the rotating shaft sleeve and movably connected to the fixed shaft sleeve, and the encoder is movably connected to one end of the rotating shaft sleeve, wherein the trigger mechanism comprises a first magnetic unit and a second magnetic unit in cooperation with each other, the first magnetic unit and the second magnetic unit are sleeved on outside of the fixed shaft sleeve, and the first magnetic unit and the second magnetic unit move along an axial direction of the fixed shaft sleeve; and wherein a magnetic pole of the first magnetic unit and a magnetic pole of the second magnetic unit are arranged in homopolarity, and the first magnetic unit and the second magnetic unit keep a distance due to a repulsive force between the first magnetic unit and the second magnetic unit.

2. The knob switch device according to claim 1, wherein the trigger mechanism comprises:

clamping slots, wherein two of the clamping slots are arranged at intervals in an axial direction outside of an extension part of the knob, a distance between the two clamping slots meets a requirement of a trigger travel of the switching element;

an elastic element, wherein one end of the elastic element is connected to the knob; and a clamping element arranged at a non-fixed end of the elastic element, wherein the clamping element is clamped to the clamping slots.

3. The knob switch device according to claim 2, wherein the elastic element is a spring, one end of the spring is fixed on an inner wall of the knob, and the other end of the spring extends toward the extension part of the knob.

4. The knob switch device according to claim 2, wherein the elastic element is a spring piece, one end of the spring piece is fixed on the outside of the extension part of the knob, and the other end of the spring piece extends along an axial direction of the extension part of the knob.

5. The knob switch device according to claim 1, wherein the first magnetic unit and the second magnetic unit are circular, an outer diameter of the first magnetic unit is smaller than an inner diameter of the second magnetic unit, and the first magnetic unit is capable of passing through an inner ring of the second magnetic unit and moving reciprocally along an axial direction of the rotating shaft sleeve.

6. The knob switch device according to claim 5, wherein the switching element is provided with a control rod or a distance sensor which faces the first magnetic unit and is configured to control switching of an operating mode of the switching element.

7. The knob switch device according to claim 1, wherein the switching element comprises a signal transmitting terminal and a signal receiving terminal, the trigger mechanism comprises a shielding member, and the shielding member is arranged between the signal transmitting terminal and the signal receiving terminal.

8. The knob switch device according to claim 7, wherein the signal transmitting terminal is an optocoupler transmitting terminal, an infrared transmitting terminal or a ray transmitting terminal.

9. The knob switch device according to claim 1, wherein the knob drives the second magnetic unit to move toward the first magnetic unit by an axial movement, and the first magnetic unit moves to trigger the switching element due to the repulsive force.

10. The knob switch device according to claim 9, wherein the first magnetic unit is capable of moving reciprocally in an inner ring of the second magnetic unit, and the switching element is switched on or off by a reciprocating movement of the first magnetic unit.

11. The knob switch device according to claim 10, wherein when the first magnetic unit is interlaced with the second magnetic unit, a direction of a force acted on the first magnetic unit by the second magnetic unit is changed, to drive the first magnetic unit to move in the second magnetic unit.

12. The knob switch device according to claim 10, wherein there is a critical state when the second magnetic unit moves toward the first magnetic unit, and the first magnetic unit is interlaced with the second magnetic unit when the second magnetic unit continues to move in the critical state.

13. The knob switch device according to claim 9, wherein the switching element comprises a control rod, the switching element is in an operating mode when the control rod is pressed by the first magnetic unit, and the switching element is in another operating mode when the control rod is not pressed by the first magnetic unit.

* * * * *